US006688570B1

(12) United States Patent
Mundt

(10) Patent No.: US 6,688,570 B1
(45) Date of Patent: Feb. 10, 2004

(54) EXTENSION LADDER UTILITY/TOOL TRAY

(76) Inventor: Larry Bruce Mundt, 17915 Fall River Cir., Houston, TX (US) 77090

( * ) Notice: Subject to any disclaimer, the term of this patent is extended or adjusted under 35 U.S.C. 154(b) by 0 days.

(21) Appl. No.: 10/338,053

(22) Filed: Jan. 8, 2003

(51) Int. Cl.[7] ..... A47G 29/02
(52) U.S. Cl. ..... 248/238; 182/129; 182/121
(58) Field of Search ..... 248/210, 211, 248/238; 182/129, 121

(56) References Cited

U.S. PATENT DOCUMENTS

| | | | | | |
|---|---|---|---|---|---|
| 4,241,807 | A | * | 12/1980 | McKenna et al. | 182/121 |
| 4,401,187 | A | * | 8/1983 | Van Patten | 182/121 |
| 4,480,810 | A | * | 11/1984 | Hall | 248/238 |
| 4,482,030 | A | * | 11/1984 | Lincourt | 182/121 |
| 4,618,030 | A | * | 10/1986 | Campbell | 182/121 |
| 4,687,075 | A | * | 8/1987 | Skaggs | 182/121 |
| 4,815,684 | A | * | 3/1989 | Kellstadt | 248/210 |
| 4,899,970 | A | * | 2/1990 | Berzina | 248/210 |
| 4,911,265 | A | * | 3/1990 | Skaggs | 182/121 |
| 4,913,394 | A | * | 4/1990 | Schmid | 248/238 |
| 5,133,525 | A | * | 7/1992 | Good | 248/210 |
| 5,191,954 | A | * | 3/1993 | Ledford | 182/129 |
| 5,421,428 | A | * | 6/1995 | Ingles | 182/106 |
| 5,429,205 | A | * | 7/1995 | Collins | 182/122 |
| 5,465,809 | A | * | 11/1995 | Panicci | 182/121 |
| 5,505,302 | A | * | 4/1996 | Ferley | 206/373 |
| 5,673,885 | A | * | 10/1997 | Pham | 248/210 |
| 5,806,817 | A | * | 9/1998 | Loud | 248/210 |
| 5,836,420 | A | * | 11/1998 | Marky, Jr. | 182/121 |
| 6,109,392 | A | * | 8/2000 | Merrick | 182/121 |
| 6,131,699 | A | * | 10/2000 | Leak, Jr. | 182/129 |
| 6,241,204 | B1 | * | 6/2001 | Bermes | 248/210 |
| 6,431,509 | B1 | * | 8/2002 | Proulx | 248/210 |
| 6,564,941 | B2 | * | 5/2003 | Hedges | 206/373 |

FOREIGN PATENT DOCUMENTS

| | | | |
|---|---|---|---|
| GB | 2 036 152 A | * | 6/1980 |
| GB | 2 161 529 A | * | 1/1986 |
| GB | 2 193 523 A | * | 2/1988 |

* cited by examiner

*Primary Examiner*—Ramon O. Ramirez
*Assistant Examiner*—Kofi Schulterbrandt

(57) ABSTRACT

The invention is a portable, lightweight, utility/tool tray designed to safely and reliably hold tools and supplies on a general use extension ladder. The utility/tool tray is a sturdy, self contained device whose base area will have an area for tool storage located in front and a larger, general area in the rear for miscellaneous items, including, but not limited to, a typical one gallon container of paint. The utility/tool tray device is designed to be easily hung on two vertically adjacent steps of the ladder so when in use, the base area of the device remains essentially horizontal and provides for the support of, as well as easy access to, the various tools and supplies of the user, while the user is performing work on the ladder.

5 Claims, 2 Drawing Sheets

EXTENSION LADDER UTILITY/TOOL TRAY

BACKGROUND

The invention relates to extension ladders, specifically a utility/tool tray for use with an extension ladder.

SUMMARY

Most situations regarding work on an extension ladder typically involve painting, installing fixtures and/or using tools while a person (the user) is elevated on the extension ladder. When elevated on the extension ladder, the user needs to have access to the tools and supplies but not be burdened with holding and/or supporting them while performing work. Due to the inherent risk associated with painting and/or using tools and supplies at elevated heights on an extension ladder, there is need of a safe and reliable device to hold the paint and/or tools and supplies of the user during work. Additionally, such a device should be designed so it can be easily used with the wide variety of extension ladders that are currently available. The invention is a device (utility/tool tray) that satisfies these needs, whereby, (1) the device is designed to accommodate a one gallon container of paint as well as the most common tools and supplies of the user, and (2) the device can be used with (hung on) nearly all general use extension ladders.

Figure 1:
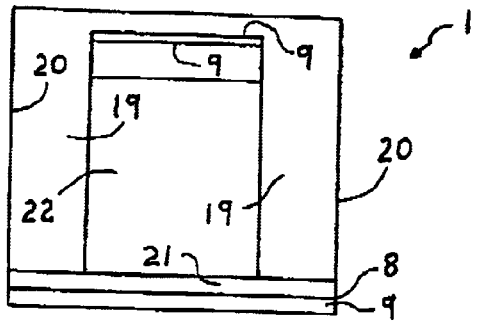
FIG. 1 Front view of utility/tool tray

The Drawings (FIGS. 1–8) illustrate the various views of the invention and references to the Drawings are contained herein. The invention is susceptible to modifications without changing its basic design. Accordingly, the invention should not be confined to its appearance as shown in the Drawings or described herein.

Figure 5:
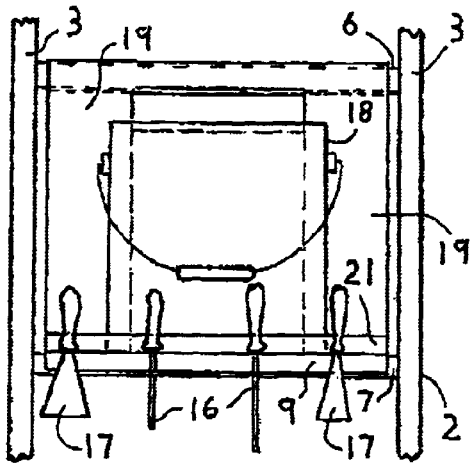
FIG. 5 Front view perspective of utility/tool tray in use
Figure 7:
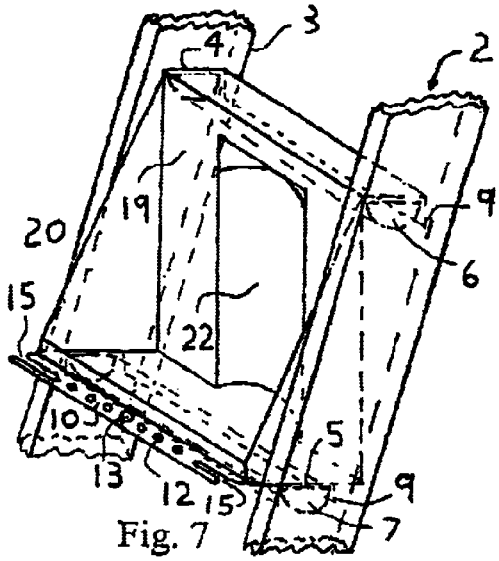
FIG. 7 Three dimensional view perspective of utility/tool tray in use, without tools or supplies FIG. 8 Side view perspective of the utility/tool tray, on a wall, not in use (e.g. in storage).

The invention is a portable utility/tool tray device 1, (utility/tool tray) designed to be hung on a general use extension ladder 2 to hold the user's tools and/or supplies. The device is made preferably of plastic and/or robber type material although the device can be made of any other lightweight durable material which will allow the device to be fabricated and marketed at a competitive price with approximate dimensions of 13"W×12"H×8.5"D. The utility/tool tray device is 1 is designed to be easy to use with an extension ladder 2, whereby the user can climb up the ladder with the device, and then once up the ladder the user only needs to hang the device on the steps of the ladder, without having to use any additional attachments to support the device on the ladder. As shown in FIGS. 5 and 7, the device is designed to fit between the side rails 3 of the extension ladder 2 and to be easily hung, via upper and lower device hanging areas 4 and 5, on two vertically adjacent steps 6 and 7 of the ladder so as to provide essentially a horizontal positioning of the base 8 of the utility/tool tray 1 when the extension ladder 2 is in the working position (leaning against a wall or structure at an approximate angle of 15 degrees from vertical). The device is designed with an upper device hanging area 4, to be hung on the higher chosen step 6 of the extension ladder 2, and a lower device hanging area 5, which is built into the underside of the base 8 of the utility/tool tray device 1, to be simultaneously hung on the step 7 below. The device is designed with guide rails 9 along the sides of both the device hanging areas 4 and 5, whereby, once the device is hung on the extension ladder 2, the device will stay situated upon the steps 6 and 7 of the extension ladder 2 and the device remains in a stable position. After use, the user can easily lift the device off the steps of the ladder if desired, replace the device on two other steps, so as to allow the user to relocate and/or remove the device while the user is standing on the ladder.

Figure 2:
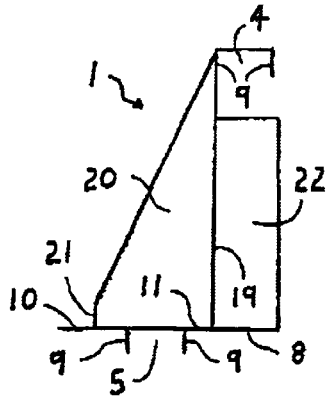
FIG. 2 Side view of utility/tool tray
Figure 3:
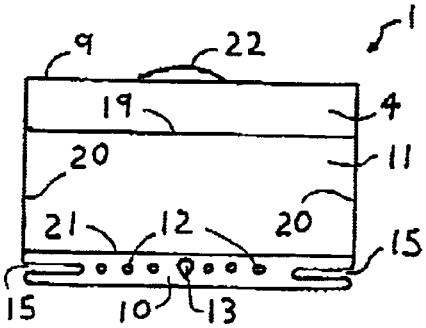
FIG. 3 Top view of utility/tool tray
Figure 4:
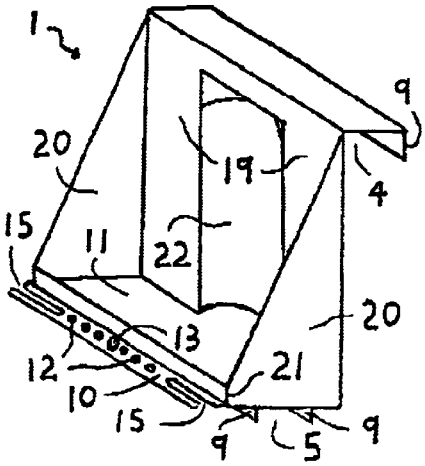
FIG. 4 Three dimensional view of utility/tool tray
Figure 6:
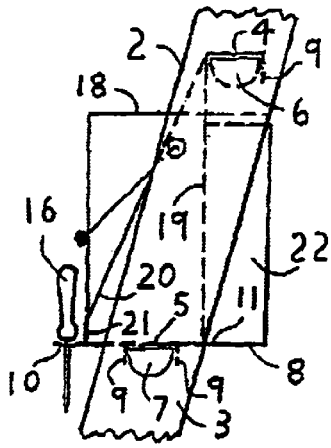
FIG. 6 Side view perspective of utility/tool tray in use
Figure 8:
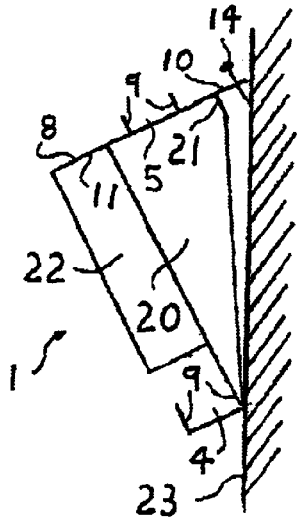

As shown in FIGS. 2, 3 and 4, the design of the base 8 of the utility/tool tray device 1, provides two separate (front and rear) storage areas 10 and 11 to accommodate tools and supplies. The front storage area 10 is intended for tools and is therefore specially designed with differently shaped and sized slots 12, 13 and 15, including varyingly sized circular slots 12, centrally located in the front storage area 10, to secure and organize basic hand tools 16, as shown in FIGS. 5 and 6. The center slot 13 is larger than the other adjacent circular slots 12 and specifically designed to be generally circular in shape, yet have a front corner, so as to provide better accommodation for the utility/tool tray device 1 to be hung, when rotated accordingly, on a nail, screw or hook 14, against a wall 23, as shown in FIG. 8, when the device is not in use. The front storage area 10 is also designed with two linear open ended slots 15, located on each end of the front storage area 10, which arm specifically shaped to accommodate flat and/or noncircular shaped tools, such as a towel, chisel or paint scraper 17, as shown particularly in FIG. 5. The front storage area 10 is also designed, when the device is hung on the ladder, to be located closest to the user so as to maximize the user's access to the tools. The rear storage area 11, located directly behind the front (tool) storage area 10, is intended for larger and/or heavier work supplies and is therefore designed, once the device is hung on the ladder, to be centrally positioned above the lower device hanging area 5 (and ladder step 2), as shown particularly in FIGS. 6 and 7, so as to use the inherent strength of the ladder step 7 to increase the rear storage area's support capabilities. As shown in FIGS. 5 and 6, the rear storage area 11 is specially, but not solely, designed to accommodate, as well as restrict the unintentional tipping over of a one gallon container of paint 18 in the center of the area, including space on both sides for placement of other items, such as paint brushes. As shown in FIGS. 1, 2 and 4, the entire rear storage area is designed with surrounding walls, with a tall rear wall 19 (circularly contoured portion 22 in the center to accommodate, as well as assist securing in place, a once gallon container of paint 18), side walls 20 that decline in height from the rear wall 19 to the front wall 21, and a short front wall 21 (separating the rear storage area 11 from the front storage area 10), so as to provide a recessed area for containment of small miscellaneous items and/or fluids, such as paint. As shown particularly in FIG. 6, the distance from the contoured portion 22 of the rear wall 19 to the front wall 21 is specifically designed to allow for a typical one gallon container of paint 18 to fit comfortably within the defined space and additionally, allow the contoured portion 22 of the rear wall 19 and the front wall 21 to restrict the one gallon container of paint 18 from movement and/or tipping over. As shown in FIGS. 2 and 5, the height of the contoured portion 22 of the rear wall 19 is shorter than the height of the rear wall 19 so as to provide room for the user to hook the upper hanging area 4 over the higher chosen step 6.

What is claimed is:

1. A device for supporting objects on a ladder having steps comprising:

a upper hanging area;

a storage portion having a base; and a lower hanging area;

wherein the upper hanging area has a horizontal portion connected by upper hanging area guide rails that project downwardly from adjacent the horizontal portion, the upper hanging area guide rails having a space therebetween for receiving a first step of a ladder;

wherein the lower banging area comprises two lower hanging area guide rails projecting downwardly from the base and having a space between the two lower hanging area guide rails for receiving a second step of a ladder;

wherein said storage portion has a front storage portion and a rear storage portion;

wherein a front wall divides said front storage portion from said rear storage portion;

wherein said base has a front storage area corresponding to said front storage portion and a rear storage area corresponding to said rear storage portion;

wherein said rear storage portion is defined by a rear wall, the front wall, two surrounding walls and said rear storage area of said base;

wherein said front storage portion is defined by said front storage area and said front wall and has slots in said front storage area for receiving a tool;

wherein both of said walls are disposed adjacent said rear wall and said front wall.

2. The device of claim 1 wherein a portion of said rear wall is contoured out of the plane of said rear wall to accommodate one of the supported objects.

3. The device of claim 1 wherein said surrounding walls decline in height from said rear wall to said front wall.

4. The device of claim 2 wherein said surrounding walls decline in height from said rear wall to said front wall.

5. The device of any one of claims 1–4 wherein the device is made from rubber or plastic.

* * * * *